United States Patent [19]

McCabe et al.

[11] 3,941,162

[45] Mar. 2, 1976

[54] REINFORCING FABRIC FOR BELTS

[75] Inventors: James L. McCabe, Winnsboro; William D. Loeble, Columbia, both of S.C.

[73] Assignee: Uniroyal Inc., New York, N.Y.

[22] Filed: Mar. 28, 1974

[21] Appl. No.: 455,708

[52] U.S. Cl. ..... 139/383 R; 139/426 R; 57/140 R; 428/245; 428/258; 428/259; 428/263; 428/265

[51] Int. Cl.[2] ..... D03D 15/00

[58] Field of Search ..... 139/420 R, 426 R, 383 R; 161/88–92; 74/231 R, 231 P, 230; 198/193; 57/140 R; 428/245, 258, 259, 263, 265

[56] References Cited

UNITED STATES PATENTS

| | | | |
|---|---|---|---|
| 2,401,260 | 5/1946 | Lord et al. | 161/91 |
| 2,792,319 | 5/1957 | Fihe | 74/231 R |
| 2,866,483 | 12/1958 | Watts et al. | 139/426 R |
| 3,086,274 | 4/1963 | Arnett | 161/91 X |
| 3,148,710 | 9/1964 | Rieger et al. | 139/426 R |
| 3,160,193 | 12/1964 | Baggett et al. | 57/140 R |
| 3,296,062 | 1/1967 | Truslow | 139/426 R |
| 3,322,163 | 5/1967 | Hughes | 139/383 R |

FOREIGN PATENTS OR APPLICATIONS

| | | | |
|---|---|---|---|
| 717,825 | 9/1965 | Canada | 161/90 |

*Primary Examiner*—James Kee Chi
*Attorney, Agent, or Firm*—Philip Sands

[57] ABSTRACT

A fabric for reinforcing rubber or rubber-like belts, the fabric comprising weft cords interlaced with and extending transversely of warp cords to retain the latter in parallel relation, the warp cords being constituted of synthetic spun yarn having no greater than two single ends plied together. The foregoing abstract is neither intended to define the invention disclosed in the specification, nor is it intended to limit the scope of the invention in any way.

10 Claims, 3 Drawing Figures

REINFORCING FABRIC FOR BELTS

BACKGROUND OF THE INVENTION

The present invention relates generally to reinforcements for industrial belts and the like, such as conveyor belts, power transmission belts, etc., and more particularly to a fabric which may be embedded in the elastomeric material of the belt to increase the tensile strength of the latter so that the belt can perform satisfactorily as a conveying or power transmitting medium.

It is well known to embed a fabric in an elastomeric material such as rubber (natural or synthetic) to reinforce the latter. Cotton and other textiles of staple fiber material have been used heretofore with moderate success in that to some degree the rubber material is reinforced thereby. However, reinforcements made of these textiles display poor resistance to shocks, impact and severe blows to which rubberized belts incorporating same are subjected in their normal course of use.

Synthetic textiles such as that constituted of polyester have therefore been used of late with increasing frequency to overcome the disadvantages associated with the cotton-like textiles aforementioned. The polyester material utilized generally is that of the "spun" variety or that of the "continuous filament" variety.

Conventional polyester yarn for reinforcing fabrics, whether the yarn is spun yarn or filament yarn, is generally a tightly woven yarn having a plurality of single ends plied together. Each single end is usually first subjected to a ring spinning process and then the single ends are together twisted about one another so as to ply them into a single cord. With regard to spun yarns, each yarn cord is defined in terms of a conventional designation of "cotton count" and by the number of single ends which are plied to one another.

Historically, a numerical designation in the form of a fraction is used to define both the cotton count and the number of single ends plied to one another. In this respect, the numerator of the fraction represents the cotton count, namely a number by which a constant (not shown in the numerator) such as 840 is multiplied. The numerator has units in the form of yarn length per unit of weight. The units associated with the constant 840 are yards per pound. The denominator of the fraction designates the number of single ends plied to one another to form a single cord. The fraction when reduced to lowest terms gives rise to still another characteristic of the yarn, namely an "equivalent cotton count". When two different spun yarns are compared to one another with regard to properties in terms of bulk, tensile strength, etc., the yarns are generally compared on the basis of having substantially identical equivalent cotton counts.

It has been determined heretofore that it is usually good practice to initially subject the fabric to a conventional RFL (resorcinol formaldehyde latex) dip, the dip not only somewhat increasing the tensile strength of the yarn material but likewise increasing the adhesion of the yarn material to that of the rubber or rubber-like material in which the fabric is to be embedded to form, for example, a reinforced belt.

Conventional practice with spun yarns has been to rely on the mechanical adhesion of the bulky and fuzzy fibers thereof to the rubber or rubber-like material rather than merely a chemical adhesive bond therebetween. Thus, the degree of bulk of a particular spun yarn has a direct bearing on its capacity to mechanically adhere to the rubber or rubber-like material of the belt in which it is embedded. The greater its bulk, the greater is its adhesion to rubber. Accordingly, a highly bulky yarn which has been dipped in an RFL bath displays extremely desirable mechanical and chemical adhesive properties and lends itself for use with good success as a belt-reinforcement means.

A disadvantage associated with conventional reinforcing fabrics constituted of spun yarn is that the yarn is of the type having many plied ends, for example a 7/7 or 8/8 yarn. This type of yarn does not have substantial bulk, despite its spun nature, because the ends are tightly twisted and plied to one another. As a result, such yarn does not present optimum adhesion to rubber.

Moreover, such multiple plied spun yarn when weaved into a fabric is quite thin. As a result, when a belt employing such a fabric is joined at its opposite ends to present a closed loop (for example transmission belts) the clamps or rivets used for joining the belt-ends can be loosened and pulled out of the latter when the belt is subjected to tension below the tensile strength of the belt itself. This is so because as much as 80% of the effective clamping capacity of such clamps or rivets depends directly on the degree to which the fabric is squeezed by the clamp. Only 15% of the effective clamping capacity of these clamps depends upon the weft cords or picks of the fabric, and only 5% thereof is due to the rubber or rubber-like material in which the fabric is embedded.

Conventional practice, therefore, is to increase the number of superposed layers of such fabric in the rubber of the belt to thereby increase the effective fabric thickness which the clamp can "bite". Thus, the breaking strength of the clamped ends of the belt (or "weak link") is substantially increased by increasing the number of fabric layers, but at the additional cost of an excessive number of fabric layers.

This disadvantage associated with the degree to which the opposite belt ends can be effectively clamped when reinforced by a low bulk (and therefore thin) spun yarn fabric, is also associated with belts reinforced by fabrics of the continuous filament variety. As is well known, filament fabrics are likewise quite thin and therefore, in the absence of a multiplicity of superposed fabrics embedded in the rubber material of the belt, such filament fabrics likewise do not present a sufficient bite thickness for the clamps.

A further disadvantage associated with the many plied spun yarn in particular is that experience has determined that after repeated use, for example several months, of a belt in which is disposed such a reinforcing yarn, the belt undergoes a reduction in tensile strength. As a result, such a reinforcing yarn is not reliable over extended periods. The latter disadvantage is believed to be a result of the number of single ends which are plied to one another and, thereby, interlocked and restrained against permitting a uniform linear distribution therealong of repeated stresses. The interlocking of the single ends with one another is believed to form local high stress zones in the yarn which tend to weaken after extended use.

SUMMARY OF THE INVENTION

Accordingly, it is an object of the present invention to provide a novel and effective fabric for reinforcing industrial belts and the like.

It is a further object of the present invention to provide such a reinforcing fabric having yarn which is dimensionally stable, long-lasting and does not undergo an appreciable reduction in tensile strength.

It is still another object of the present invention to provide such a fabric having yarn of greater bulk than that of conventional synthetic spun yarn and, thereby, a fabric which has (a) greater mechanical adhesion to rubber or rubber-like materials, and (b) a higher degree of clamp pull-out resistance for obviating the need for an excessive number of superposed fabric layers in the belt rubber.

The present invention may be briefly characterized as a fabric for reinforcing industrial belts, the fabric having closely spaced and parallel warp cords, and weft cords interlaced with and extending transversely of the warp cords to retain the latter in parallel relation. The warp cords are constituted of synthetic, preferably polyester, spun yarn having no greater than two single ends plied together and an equivalent cotton count of 1.0. The warp cords may each be constituted of a single end having a cotton count of 1.0 or, alternatively, the warp cords may be constituted of two plied single ends, each end having a cotton count of 2.0 (each end therefore being a 2/1 yarn). After the fabric is formed of the warp and weft cords, the fabric is RFL treated, theremoset and embedded in the elastomeric material of a belt.

BRIEF DESCRIPTION OF THE DRAWINGS

The above and additional objects and advantages of this invention will be more clearly understood from the following detailed description thereof when read in conjunction with the accompanying drawings, in which.

DETAILED DESCRIPTION OF THE INVENTION

Figure 1:
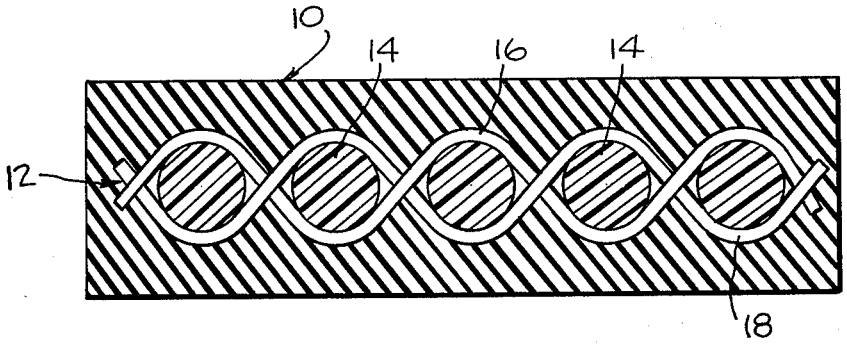
FIG. 1 is a partially cross-sectional view of one embodiment pursuant to the belt of the present invention, the view taken laterally of the belt.
Figure 2:
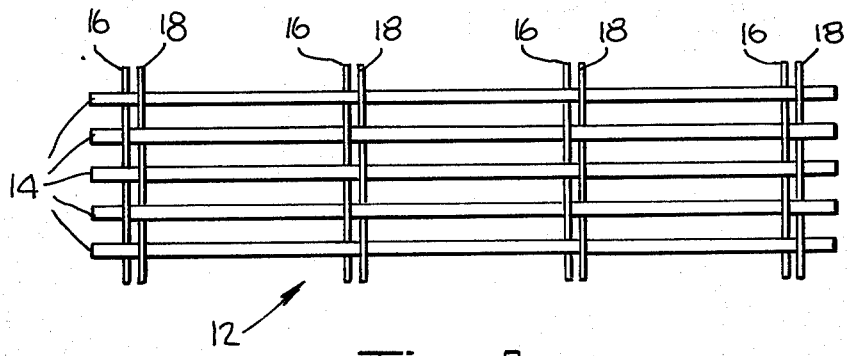
FIG. 2 is a schematic plan view of the fabric pursuant to the present invention.

Referring now to the drawings, and more particularly to FIGS. 1 and 2, the present invention relates to means for reinforcing industrial belts such as conveyor belts, power transmission belts, etc. The belt pursuant to one embodiment of the present invention is denoted generally by the reference character 10 and is constituted of an elastomeric material such as natural or synthetic rubber. The reinforcing means for the belt 10 is a fabric denoted generally by the reference character 12. The fabric 12 comprises closely spaced and parallel warp cords 14, and weft cords 16, 18 interlaced with and extending transversely of the warp cords 14 to retain the latter in parallel relation. Each weft cord 16 is associated with a corresponding weft cord 18 and runs in opposing relation with the latter alternately over and under adjacent ones of the warp cords 14.

The essence of the present invention lies not necessarily in the interlaced relationship of the warp and weft cords with one another, but rather lies in the very nature of the warp and weft cords. In this respect, the warp cords are of a specific type which is constituted of spun yarn having no greater than two single ends plied together and an equivalent cotton count of 1.0. For example, the warp cords may be constituted of a single end having a cotton count of 1.0. Alternatively, the warp cords may be constituted of two plied single ends, each end having a cotton count of 2.0. Thus, the warp cords may be characterized as a 1/1 or a 2/2 yarn. The 1/1 yarn designates a single yarn having a cotton count of 1.0 and constituted of a single end of yarn. On the other hand, the 2/2 yarn designates a single yarn having a cotton count of 2.0 and constituted of 2 plied single ends, each end being a 2/1 yarn.

It has been determined that a 1/1 spun yarn or a 2/2 spun yarn demonstrates a tensile strength which is significantly higher than that of a conventional multi-plied 3/3, 4.5/4, 7/7 or 8/8 yarn after a period of several months. The latter multi-plied yarns exhibit a tensile strength loss after several months, whereas after such a period a 1/1 or a 2/2 yarn exhibits tensile strength retention.

Figure 3:
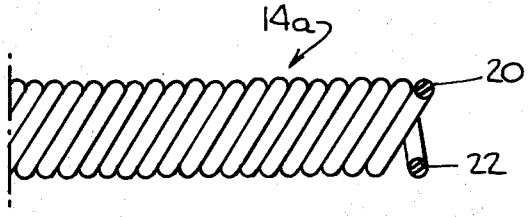
FIG. 3 is an enlarged, fragmentary perspective view of an alternate embodiment of a single warp cord pursuant to the present invention.

For purposes of illustration, a 1/1 spun yarn is illustrated in FIG. 1 and designated by the reference character 14, whereas a 2/2 spun yarn is shown in FIG. 3 and designated by the reference character 14a. The 2/2 yarn 14a in FIG. 3 is comprised of two single ends designated by the reference characters 20 and 22, respectively.

Accordingly, as may be readily appreciated, the yarn pursuant to the present invention, whether it be a 1/1 spun yarn or a 2/2 spun yarn, is much more effective and reliable than that of a conventional multi-plied (3/3 or greater) yarn when used for fabric warp cords in a belt-reinforcing environment, this because of its capacity to resist undergoing a reduction in tensile strength after a significant period of use.

Another significant advantage accrued by the nature of the present invention is that a 1/1 or a 2/2 yarn exhibits greater bulk than that of a tightly woven yarn of the multi-plied (3/3 or greater) variety. Accordingly, when a yarn pursuant to the present invention is dipped in an RFL bath, the RFL deeply penetrates uniformly the full cross-sectional extent of the yarn and, thus, a greater amount of RFL is captured therein. On the other hand, when a conventional multi-plied (3/3 or greater) yarn is dipped in an RFL bath, because of the generally tightly woven nature of the latter yarn, a lesser amount of RFL is entrapped in the yarn and there is a lesser degree of uniformity with regard to the extent of penetration throughout the cross-sectional extent of the yarn.

As a result, when a 1/1 or 2/2 spun yarn of the present invention is embedded in an elastomeric material such as natural or synthetic rubber, the yarn tends to chemically adhere to the rubber material to an extent which is substantially greater than the degree to which the lesser RFL impregnated conventional multi-plied (3/3 or greater) yarn adheres to the rubber material.

The greater bulk of the yarn pursuant to the present invention also contributes to increasing the mechanical adhesion thereof to rubber. Test data has demonstrated that a 2/2 spun yarn has approximately 45 lbs. of adhesion, whereas a 7/7 or 8/8 yarn only has approximately 25 lbs. of adhesion. Thus, because of increased mechanical and chemical adhesion effected by the yarn pursuant to the present invention, the fabric constituted of that yarn can more effectively and reliably cooperate with the rubber material for reinforcing the latter.

Another very valuable attribute of the present invention, which is also due to the bulky nature of the yarn, is that the yarn has much higher clamp "pullout" resistance than does the thinner filament yarn or conventional thin multi-plied (3/3 or greater) spun yarn. As a result, a lesser number of superposed fabric layers is necessary for being embedded in the belt rubber for purposes of providing a highly effective bite thickness for clamps which are to join the opposite ends of the belt to provide a closed loop. Thus, from an economical standpoint, the fabric of the present invention is much more desirable than is conventional filament or spun yarn.

It has been determined that synthetic spun yarn, such as that constituted of polyester, is that which is most preferable pursuant to the present invention. Polyester, whether it be regular tenacity polyester or high tenacity polyester, itself displays significant tensile strength which is greater than that of the natural fibers such as cotton and the like, whereas the spun 1/1 or 2/2 nature of the yarn gives it its high bulk characteristic.

It will be understood, that the fabric, such as the fabric 12 in FIG. 2, after having been RFL treated can be thermoset to increase its dimensional stability. It will be also understood that although the warp cords 14, 14*a* have been described as being constituted of synthetic spun yarn having no greater than two single ends plied together and an equivalent cotton count of 1.0, that the weft cords 16, 18 need not be so constituted and restricted and thus may be the same as or different from the warp cords 14, 14*a*. For example, the warp cords 14 may be of the 1/1 spun polyester variety, whereas the weft cords 16, 18 may be continuous filament 1260/1 nylon.

It will be understood that the foregoing description of the preferred embodiments of the present invention is for purposes of illustration only and that the various structural and operational features and relationships herein disclosed are susceptible to a number of modifications and changes none of which entails any departure from the spirit and scope of the present invention as defined in the hereto appended claims.

What is claimed is:

1. A fabric comprising closely spaced and parallel warp cords, and weft cords interlaced with and extending transversely of said warp cords to retain the latter in parallel relation, said warp cords being constituted of synthetic spun yarn having no greater than two single ends plied together and an equivalent cotton count of 1.0.

2. A fabric as claimed in claim 1, wherein said warp cords are each constituted of a single end having a cotton count of 1.0.

3. A fabric as claimed in claim 1, wherein said warp cords are each constituted of two plied single ends, each end having a cotton count of 2.0.

4. A fabric as claimed in claim 1, wherein said warp cords are constituted of polyester.

5. A fabric as claimed in claim 1, wherein said warp and weft cords are identical.

6. A fabric as claimed in claim 1, wherein said warp and weft cords are different.

7. A fabric as claimed in claim 1, wherein said warp and weft cords are Resorcinol Formaldehyde Latex treated.

8. A fabric as claimed in claim 1, wherein said warp and weft cords are thermoset against shrinkage.

9. A fabric as claimed in claim 1, in combination with an elastomeric material in which is embedded said fabric.

10. A fabric as claimed in claim 9, wherein said elastomeric material is in the form of a belt.

* * * * *